US011090944B2

(12) United States Patent
Takiguchi et al.

(10) Patent No.: US 11,090,944 B2
(45) Date of Patent: Aug. 17, 2021

(54) LIQUID STORAGE BOTTLE

(71) Applicant: CANON KABUSHIKI KAISHA, Tokyo (JP)

(72) Inventors: Shoki Takiguchi, Tokyo (JP); Kenta Udagawa, Tokyo (JP); Hiroki Hayashi, Kawasaki (JP); Hiroshi Koshikawa, Yokohama (JP); Noriyasu Nagai, Tokyo (JP); Manabu Ohara, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/822,837

(22) Filed: Mar. 18, 2020

(65) Prior Publication Data

US 2020/0307228 A1 Oct. 1, 2020

(30) Foreign Application Priority Data

Mar. 27, 2019 (JP) ..... JP2019-060581

(51) Int. Cl.
*B41J 2/175* (2006.01)
*B41J 2/135* (2006.01)
*B65D 41/34* (2006.01)

(52) U.S. Cl.
CPC ..... *B41J 2/1754* (2013.01); *B41J 2/135* (2013.01); *B65D 41/34* (2013.01)

(58) Field of Classification Search
CPC . B41J 2/1754; B41J 2/135; B41J 2/165; B41J 29/02; B65D 41/34; B65D 41/04; B65D 47/06; B65D 51/18
See application file for complete search history.

(56) References Cited

U.S. PATENT DOCUMENTS 10,239,323 B2 * 3/2019 Nagashima ..... B41J 2/17553

FOREIGN PATENT DOCUMENTS

JP 2004-352360 A 12/2004

* cited by examiner

*Primary Examiner* — Thinh H Nguyen
(74) *Attorney, Agent, or Firm* — Canon U.S.A., Inc. IP Division

(57) ABSTRACT

A liquid storage bottle includes a bottle main body, a nozzle having a discharge port through which a liquid stored in the bottle main body is discharged, a cap mountable on the nozzle and a sealing unit sealing the discharge port when the cap is mounted on the nozzle. The sealing unit includes an annular first rib, an annular second rib and an annular third rib. The outer peripheral surface of the first rib is inclined with respect to the axial direction of the nozzle so that a diameter decreases toward a tip portion of the first rib and the inner peripheral surface of the third rib is inclined with respect to the axial direction of the cap so that a diameter increases toward a tip portion of the third rib.

8 Claims, 13 Drawing Sheets

LIQUID STORAGE BOTTLE

FIELD OF THE DISCLOSURE

The present disclosure relates to a liquid storage bottle which stores a liquid therein.

DESCRIPTION OF THE RELATED ART

In a liquid tank used in a liquid ejection device such as an ink jet recording device, a liquid can be replenished from a separately prepared liquid storage bottle through an inlet for injecting the liquid. In the liquid storage bottle for replenishing the liquid, in order to prevent hands or surroundings of a user from being dirty, one of an inner peripheral surface and an outer peripheral surface of a tip of a nozzle for discharging the liquid is sealed. Accordingly, the liquid storage bottle can have seal property so that the liquid does not leak. This is particularly important because when a content is ink, a general surface tension (about 30 mN/m) of the ink is smaller than a surface tension (about 73 mN/m) of water, and thus, the ink easily leaks even from a small gap. However, if only one of the inner peripheral surface and the outer peripheral surface of the nozzle tip is sealed, a sealing state of the liquid storage bottle is broken due to impacts such as dropping, and thus, the ink may leak. Further, in a case where only the outer peripheral surface of the nozzle tip is sealed, there is also a problem that ink attached to the nozzle tip drips outward when a cap is opened. To solve the problems, Japanese Patent Application Laid-Open No. 2004-352360 discloses a sealing structure of a bottle capable of sealing both an inner peripheral surface and an outer peripheral surface of a nozzle tip.

In the sealing structure described in Japanese Patent Application Laid-Open No. 2004-352360 an outer peripheral surface of a nozzle tip is sealed by an annular rib protruding from a bottom surface of a cap toward the nozzle tip. However, the rib is formed so that an inner diameter decreases toward a tip portion. Therefore, there is a problem that an operation force required by a user when the cap is opened or closed increases, and in some cases, there is a possibility that the user cannot open the cap.

SUMMARY OF THE DISCLOSURE

An aspect of the present disclosure is to provide a liquid storage bottle which suppresses liquid leakage due to an external impact while reducing the operation force required when opening or closing the cap.

According to one aspect of the present disclosure, there is provided a liquid storage bottle including: a bottle main body; a nozzle which has a discharge port through which a liquid stored in the bottle main body is discharged; a cylindrical cap which is mountable on the nozzle to open or close the discharge port; and a sealing unit which seals the discharge port when the cap is mounted on the nozzle, in which the sealing unit includes an annular first rib which is provided in the nozzle, an annular second rib which is provided in the cap and an annular or arc third rib which is provided in the cap, the first rib protrudes in an axial direction of the nozzle along a peripheral edge portion of the discharge port, the second rib protrudes in an axial direction of the cap from a surface of the cap facing the discharge port and includes an outer peripheral surface which is fitted to an inner peripheral surface of the first rib, the third rib protrudes in the axial direction of the cap from the surface of the cap facing the discharge port and includes an inner peripheral surface which comes into contact with an outer peripheral surface of the first rib, and the outer peripheral surface of the first rib is inclined with respect to the axial direction of the nozzle so that a diameter decreases toward a tip portion of the first rib and/or the inner peripheral surface of the third rib is inclined with respect to the axial direction of the cap so that a diameter increases toward a tip portion of the third rib.

Further features and aspects of the present disclosure will become apparent from the following description of exemplary embodiments with reference to the attached drawings.

DESCRIPTION OF THE EMBODIMENTS

Figure 1:
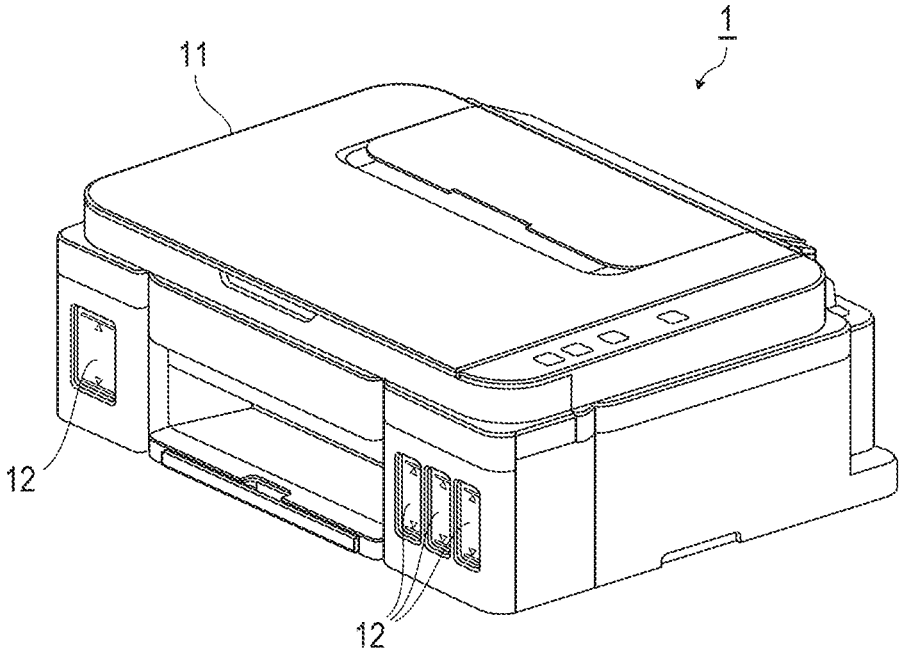
FIG. 1 is a perspective view of an example liquid ejection device used in a liquid storage bottle of the present disclosure.

Hereinafter, numerous embodiments of the present disclosure will be described with reference to the drawings. In the present specification, a case where is a liquid ejection device (ink jet recording device) is replenished with a liquid (ink) will be described as an example of a use of a liquid storage bottle of the present disclosure. However, the use of the liquid storage bottle is not limited to this. Moreover, in the following descriptions, configurations having the same functions are denoted by the same reference numerals in the drawings, and descriptions thereof may be omitted.

FIG. 1 is a perspective view of a liquid ejection device used in a liquid storage bottle of the present disclosure.

A liquid ejection device 1 is a serial type ink jet recording device and has a housing 11 and large-capacity liquid tanks 12 which are disposed inside the housing 11. The liquid tank 12 stores ink which is a liquid ejected to a recording medium (not illustrated).

Figure 2:
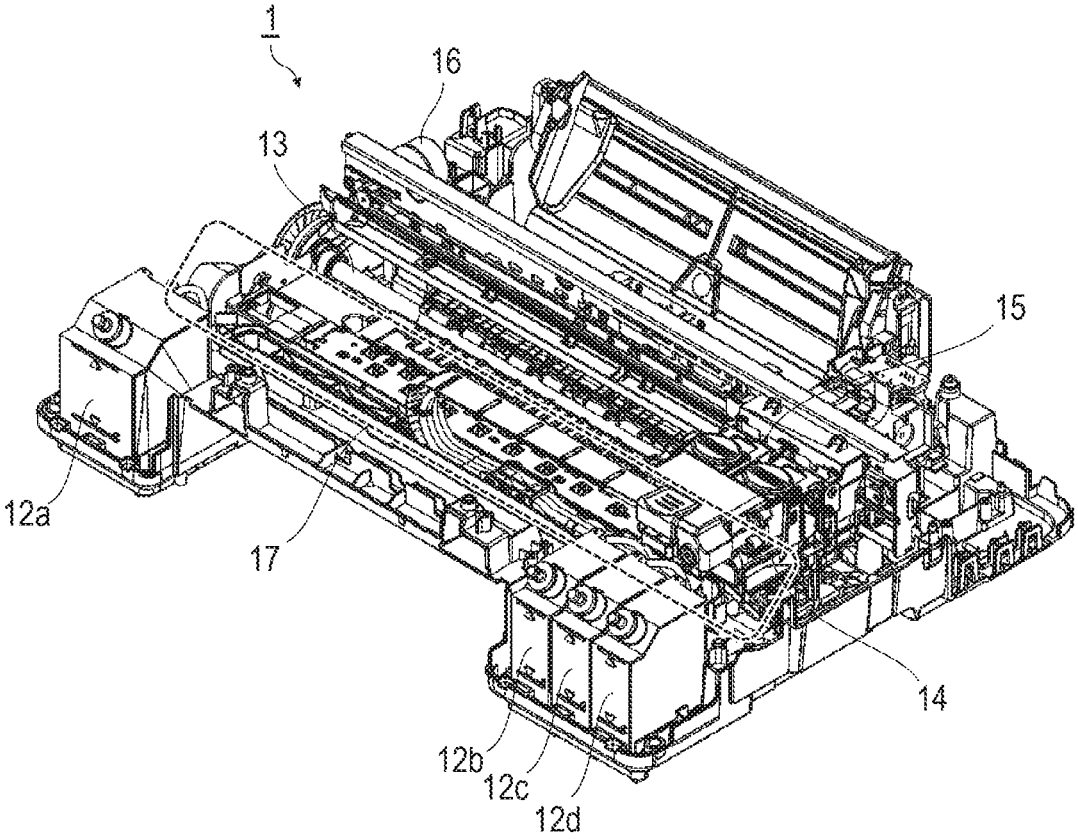
FIG. 2 is a perspective view illustrating an example internal configuration of a main part of the liquid ejection device illustrated in FIG. 1.

FIG. 2 is a perspective view illustrating an internal configuration of a main part of the liquid ejection device 1 illustrated in FIG. 1.

The liquid ejection device 1 includes a conveyance roller 13 which conveys the recording medium (not illustrated), a carriage 15 in which a recording head 14 for ejecting a liquid is provided and a carriage motor 16 which drives the carriage 15. For example, the recording medium is paper. However, the recording medium is not particularly limited as long as an image is formed by the liquid ejected from the recording head 14. The conveyance roller 13 is intermittently driven rotationally, and thus, the recording medium is intermittently conveyed. As the carriage motor 16 is rotationally driven, the carriage 15 reciprocates in a direction intersecting a conveyance direction of the recording medium and the liquid is ejected to the recording medium from an ejection port provided in the recording head 14 during reciprocating scanning of the carriage 15. Accordingly, the image is recorded on the recording medium.

The liquid is stored in the liquid tank 12 and is supplied to the recording head 14 through a liquid flow path 17. As the liquid, ink of four colors (for example, cyan, magenta, yellow and black) is used, and as the liquid tank 12, four liquid tanks 12*a* to 12*d* each storing the ink of each color are provided. Each of the four liquid tanks 12*a* to 12*d* is disposed in a front surface portion of the liquid ejection device 1 inside the housing 11.

Figure 3:
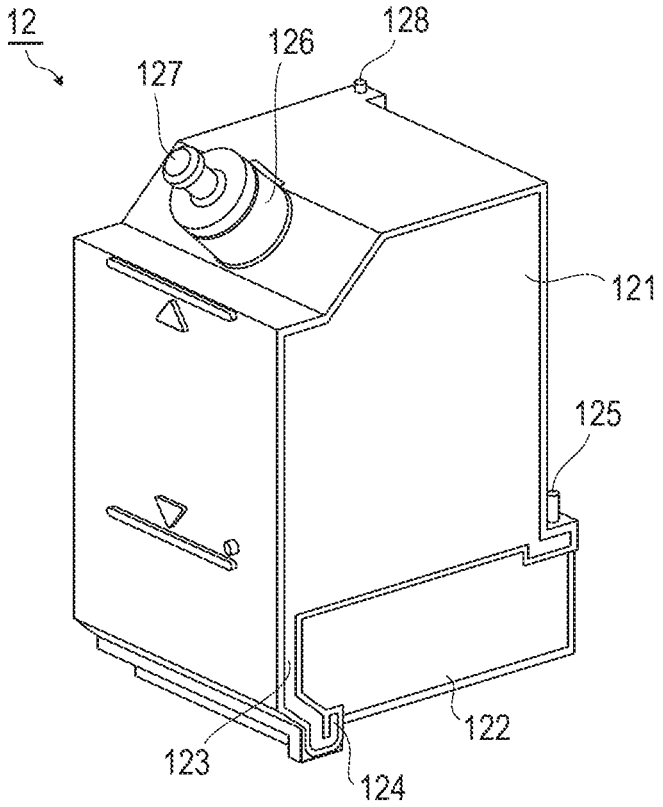
FIG. 3 is a perspective view of an example liquid tank of the liquid ejection device illustrated in FIG. 1.

FIG. 3 is a perspective view of the liquid tank 12 of the liquid ejection device 1 illustrated in FIG. 1.

An inside of the liquid tank 12 is partitioned into a storage chamber 121 for storing the liquid and a buffer chamber 122 for storing air, and a portion of a bottom wall of the storage chamber 121 forms a ceiling wall of the buffer chamber 122. The storage chamber 121 and the buffer chamber 122 communicate with each other via a communication flow path 123 which is provided along one of side walls of the storage chamber 121. An opening portion 124 which is an outlet of the buffer chamber 122 side of the communication flow path 123 is provided on a lower side of the buffer chamber 122. A supply port 125 which communicates with the recording head 14 via a tube (not illustrated) and through which the liquid is supplied to the recording head 14 is provided at an end portion of a bottom wall of the storage chamber 121. An inlet 126 for replenishing the liquid tank 12 with the liquid is provided on an upper surface of the liquid tank 12. A tank cap 127 for sealing the storage chamber 121 in the liquid tank 12 can be mounted on the inlet 126. FIG. 3 illustrates the liquid tank 12 on which the tank cap 127 mounted. An air opening 128 is provided on the upper surface of the liquid tank 12 to allow the buffer chamber 122 to communicate with the outside air.

In this configuration, in a case where the liquid in the storage chamber 121 is consumed in a state where the storage chamber 121 is sealed by the tank cap 127, external air can be introduced into the storage chamber 121 through air opening 128. In addition, even if air in a space above a liquid level of the storage chamber 121 is expanded due to a pressure fluctuation or a temperature change, the liquid can be stored in the buffer chamber 122. Accordingly, it is possible to prevent the liquid from leaking from the air opening 128.

First Example Embodiment

Figure 4:
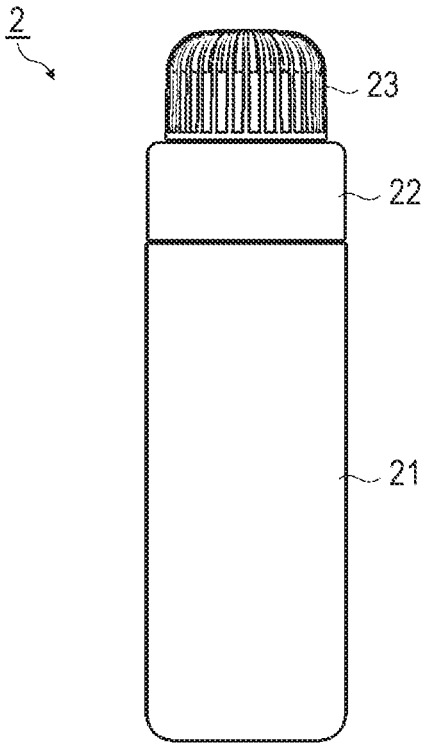
FIG. 4 is a side view of a liquid storage bottle according to a first example embodiment.
Figure 5:
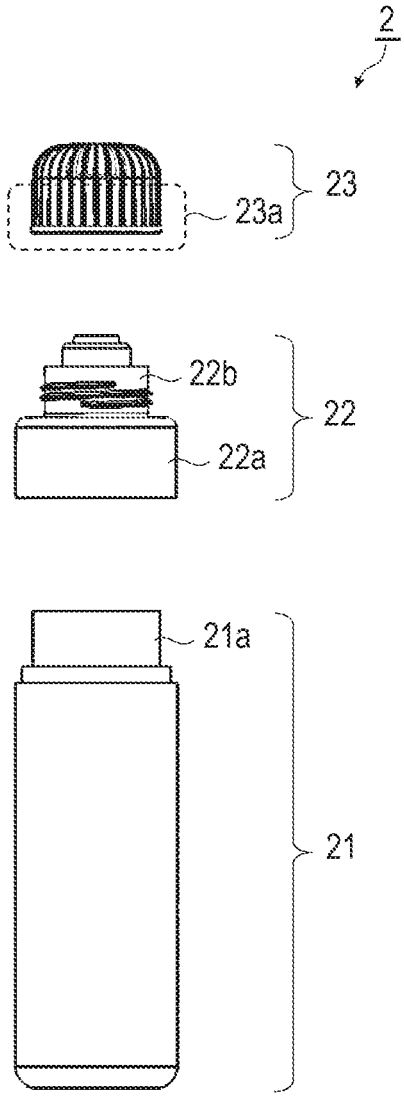
FIG. 5 is an exploded side view of the liquid storage bottle illustrated in FIG. 4.

FIG. 4 is a side view of a liquid storage bottle 2 according to a first embodiment of the present disclosure. FIG. 5 is an exploded side view of the liquid storage bottle 2 illustrated in FIG. 4.

The liquid storage bottle 2 is a cylindrical container for replenishing the liquid tank 12 with the liquid, and includes a bottle main body 21 which stores the liquid, a nozzle 22 and a cap 23. The nozzle 22 is fixed to the bottle main body 21 and has a function of discharging the liquid stored in the bottle main body 21. The cap 23 can be mounted on the nozzle 22 so as to open and close a discharge port 22*c* described later of the nozzle 22, and has a function of shielding an inside of the bottle main body 21 from an outside air and sealing the liquid storage bottle 2. In the first embodiment, both the bottle main body 21 and the nozzle 22 are resin parts and are fixed to each other by welding as described later. However, the bottle main body 21 and the nozzle 22 may be sealed with a flexible part therebetween so as to be fixed to each other.

A bottle welding portion 21*a* is formed in an upper portion of the bottle main body 21 and a nozzle welding portion 22*a* is formed in a lower portion of the nozzle 22. One of an inner peripheral surface and a bottom surface of the nozzle welding portion 22*a* is welded to the bottle welding portion 21*a*, and thus, the nozzle 22 is fixed to the bottle main body 21. A nozzle screw portion 22*b* having a male screw formed on an outer peripheral surface is formed at a center portion of the nozzle 22 and a cap screw portion 23*a* having a female screw formed on an inner peripheral surface is formed in a lower portion of the cap 23. The male screw of the nozzle screw portion 22*b* is screwed to the female screw of the cap screw portion 23*a*, and thus, the cap 23 is mounted on the nozzle 22.

Figure 6:
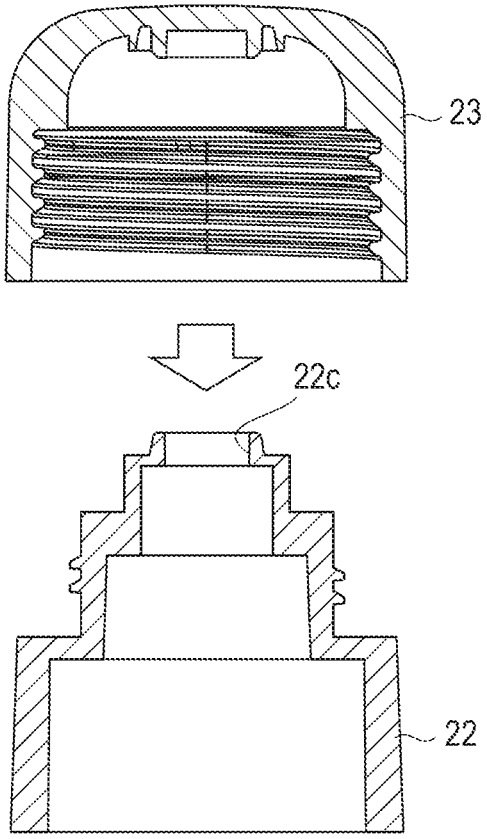
FIG. 6 is a cross-sectional view of a nozzle and a cap according to the first example embodiment.
Figure 7:
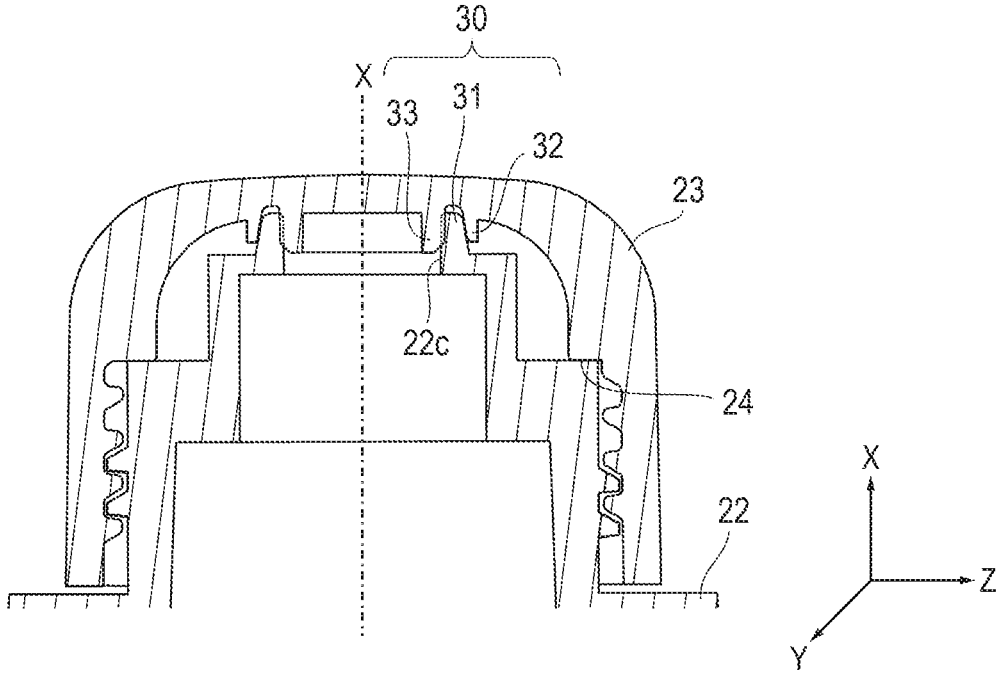
FIG. 7 is a cross-sectional view of the cap when the cap is mounted on the nozzle.

FIG. 6 is a cross-sectional view of the nozzle 22 and the cap 23 of the liquid storage bottle 2 of the first embodiment and FIG. 7 is a cross-sectional view of the nozzle 22 and the cap 23 when the cap 23 is mounted on the nozzle 22. An axial direction X in FIG. 7 is a direction substantially parallel to a longitudinal direction of the liquid storage bottle 2 and vertically intersects with a plane formed by the axial directions Y and Z. The plane formed by the axial directions Y and Z is substantially parallel to a plane formed by the liquid in the liquid storage bottle 2 when the liquid is stored in the liquid storage bottle 2 and the cap 23 is established upward. In drawings illustrated below, a relationship between the axial directions X, Y and Z is the same. In the cap 23 and the nozzle 22, a direction parallel to the axial direction X is defined as a longitudinal direction.

The nozzle 22 has the discharge port 22*c* which discharges the liquid. A sealing unit 30 which seals the discharge port 22*c* when the cap 23 is mounted on the nozzle 22 is provided between the nozzle 22 and the cap 23. The sealing unit 30 includes an annular first rib 31 which is provided on the nozzle 22 and both annular second and third ribs 32 and 33 which are provided on the cap 23. The first rib 31 protrudes in the axial direction X of the nozzle 22 along a peripheral edge portion of the discharge port 22*c* and the second and third ribs 32 and 33 respectively protrude in the axial direction X of the cap 23 from a bottom surface (a surface facing the discharge port 22*c*) of the cap 23.

The cap 23 includes an abutment surface 24 which abuts on the nozzle 22 in the axial direction X of the cap 23 when the cap 23 is mounted on the nozzle 22. Accordingly, excessive tightening of the cap is suppressed and sealing of the discharge port 22*c* by the sealing unit 30 is appropriately performed.

Figure 8A:
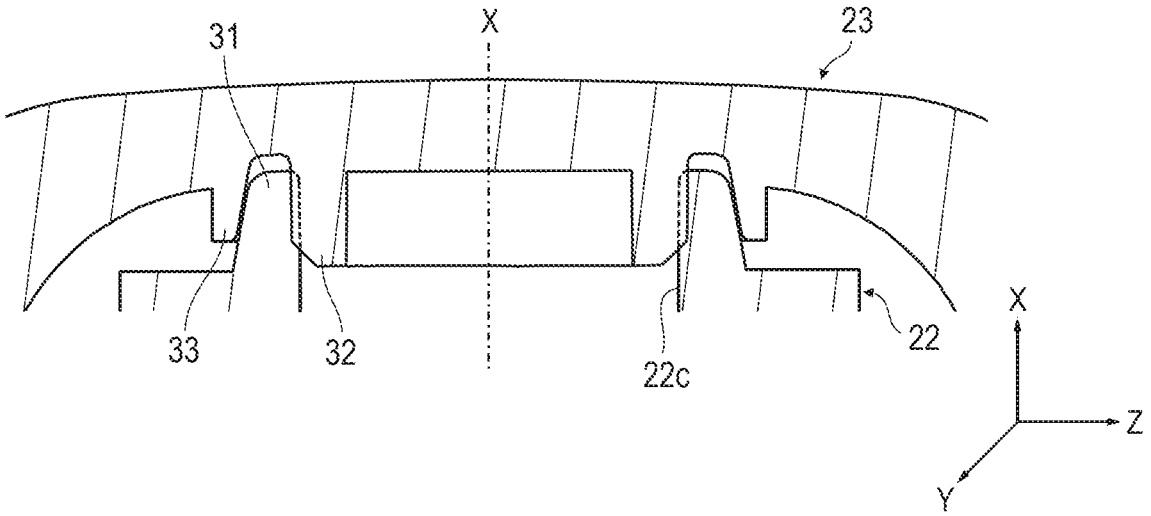
FIG. 8A is an enlarged cross-sectional view of a sealing state of a sealing unit according to the first example embodiment.
Figure 8B:
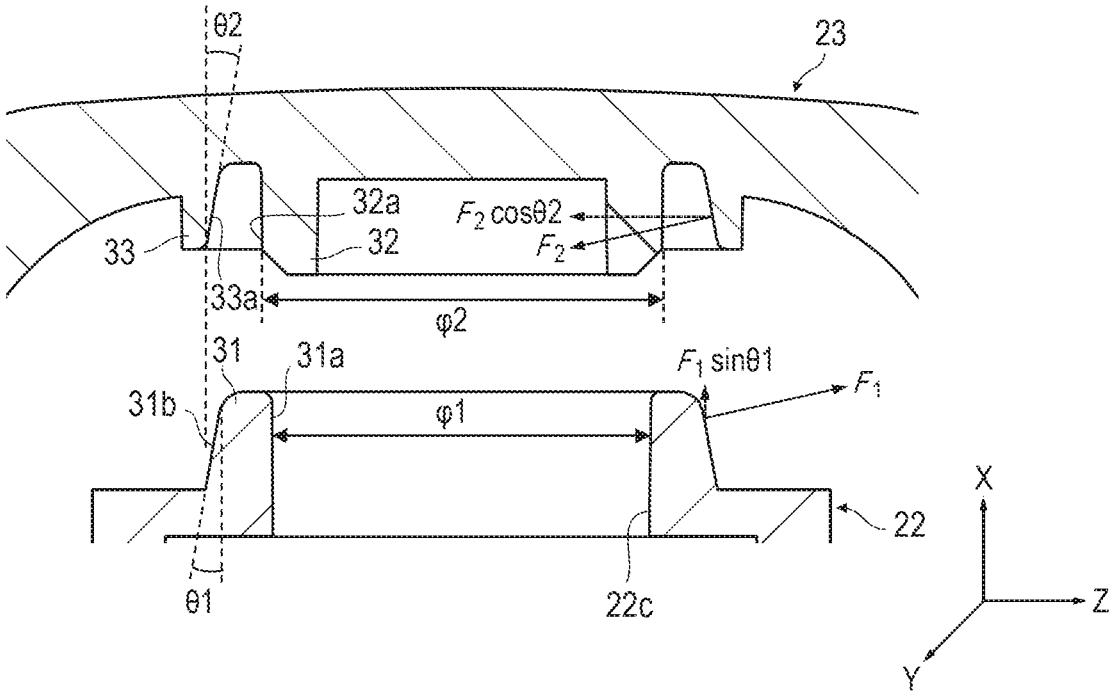
FIG. 8B is an enlarged cross-sectional view in a state where sealing of the sealing unit according to the first example embodiment is released.
Figure 9A:
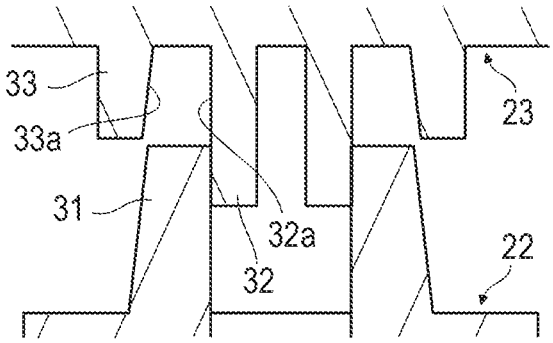
FIGS. 9A, 9B, 9C and 9D are enlarged cross-sectional views illustrating modification examples of the sealing unit according to the first example embodiment.
Figure 9C:
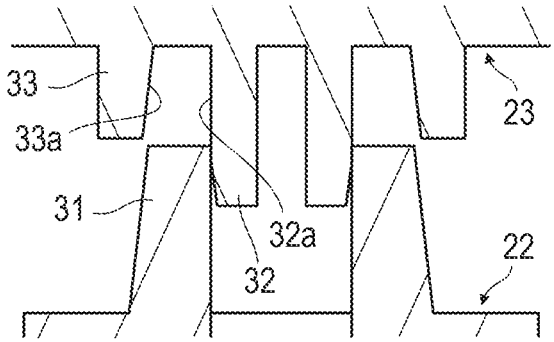
Figure 9B:
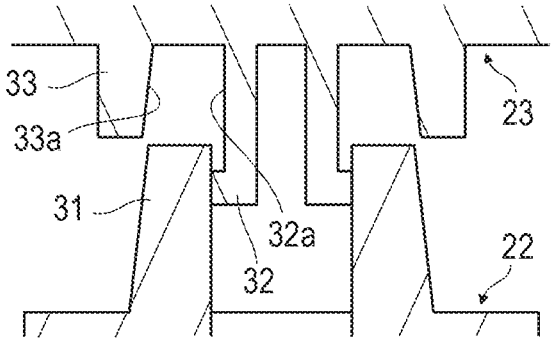
Figure 9D:
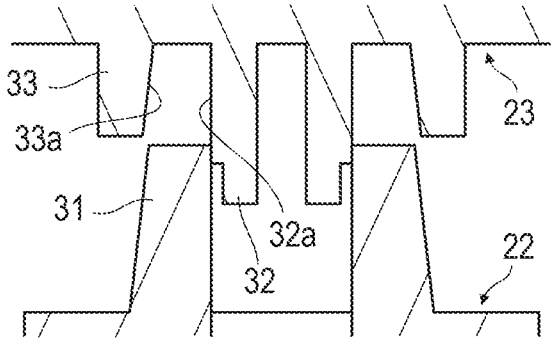

FIG. 8A is an enlarged cross-sectional view of the sealing unit of the first embodiment and FIG. 8B is an enlarged cross-sectional view of the sealing unit when the sealing of the discharge port 22*c* is released.

The second rib 32 has an outer peripheral surface 32*a* which is fitted to the inner peripheral surface 31*a* of the first rib 31 when the cap 23 is mounted on the nozzle 22. In other words, a diameter $\phi 2$ of the outer peripheral surface 32*a* of the second rib 32 is larger than the diameter $\phi 1$ of the inner peripheral surface 31*a* of the first rib 31. Therefore, when the cap 23 is mounted on the nozzle 22, the outer peripheral surface 32*a* of the second rib 32 can be press-fitted into the inner peripheral surface 31*a* of the first rib 31. Accordingly, the inner peripheral surface 31*a* of the first rib 31 can be sealed by the second rib 32, and thus, the discharge port 22*c* of the nozzle 22 can be sealed.

The third rib 33 has an inner peripheral surface 33*a* which comes into contact with the outer peripheral surface 31*b* of the first rib 31 when the outer peripheral surface 32*a* of the second rib 32 is fitted to the inner peripheral surface 31*a* of the first rib 31. Accordingly, in a case where the first rib 31 is deformed radially outward by the press-fitting of the second rib 32, the third rib 33 can apply a radially inward reaction force to the outer peripheral surface 31*b* of the first rib 31. As a result, seal property between the inner peripheral surface 31*a* of the first rib 31 and the outer peripheral surface 32*a* of the second rib 32 can be further improved. In addition, even when a force is applied radially outward to the first rib 31 due to impacts such as dropping, the third rib 33 can apply the radially inward reaction force to the outer peripheral surface 31*b* of the first rib 31. As a result, it is possible to prevent the sealing of the discharge port 22*c* from being released due to an external impact and it is possible to suppress liquid leakage from the discharge port 22*c*.

Furthermore, the inner peripheral surface 33*a* of the third rib 33 is inclined with respect to the axial direction X of the cap 23 so that a diameter increases toward a tip portion of the third rib 33. Thereby, a vertical force acting when the cap 23 is mounted is dispersed on an inclined surface, and thus, an operation force required when opening and closing the cap 23 can be reduced. Moreover, the outer peripheral surface 31*b* of the first rib 31 is inclined with respect to the axial direction X of the nozzle 22 so that a diameter decreases toward a tip portion of the first rib 31. As a result, the vertical force acting when the cap 23 is mounted is dispersed on the inclined surface and a contact surface pressure between the first rib 31 and the third rib 33 is reduced. Accordingly, it is possible to suppress an increase in the operation force required when opening or closing the cap 23.

According to this configuration, it is possible to suppress the liquid leakage due to the external impact while reducing the operation force required when opening and closing the cap 23 even for a highly rigid material. Moreover, if at least one of the outer peripheral surface 31*b* of the first rib 31 and the inner peripheral surface 33*a* of the third rib 33 is inclined, a reduction in the operation force required when opening and closing the cap 23 can be expected. Accordingly, the outer peripheral surface 31*b* and the inner peripheral surface 33*a* need not necessarily be inclined.

An inclination angle $\theta 1$ of the outer peripheral surface 31*b* of the first rib 31 with respect to the axial direction X of the nozzle 22 and an inclination angle $\theta 2$ of the inner peripheral surface 33*a* of the third rib 33 with respect to the axial direction X of the cap 23 can satisfy relationships of $0° \leq \theta 1 \leq 45°$ and $0° < \theta 2 \leq 45°$ or can satisfy relationships of $0° \leq \theta 1 \leq 45°$ and $0° \leq \theta 2 \leq 45°$. In this case, when the cap 23 is closed, in a reaction force $F_1$ of the first rib 31 acting on the third rib 33, a component $F_1 \sin \theta 1$ in a direction opposite to a mounting direction (direction opposite to the axial direction X) of the cap 23 can be reduced. Accordingly, the operation force required when opening and closing the cap 23 can be reduced. In addition, when the external impact such as dropping is applied, in a reaction force $F_2$ of the third rib 33 acting on the first rib 31, a radially inward component $F_2 \cos \theta 2$ can be increased. As a result, a radially outward deformation of the first rib 31 can be suppressed and a sealing state of the discharge port 22*c* can be maintained even when the liquid storage bottle 2 is dropped.

FIGS. 9A to 9D are enlarged cross-sectional views illustrating modification examples of the second rib in the sealing unit of the first embodiment.

As illustrated in FIGS. 9A to 9D, when the cap 23 is opened or closed, there can be a period when only the outer peripheral surface 32*a* of the second rib 32 is in contact with the first rib and the inner peripheral surface 33*a* of the third rib 33 is not in contact with the first rib. In other words, a region of the outer peripheral surface 32*a* of the second rib 32 which is in contact with the first rib 31 can be closer to the nozzle 22 than a region of the inner peripheral surface 33*a* of the third rib 33 which is in contact with the first rib 31. Accordingly, when the cap 23 is opened, the sealing between the first rib 31 and the third rib 33 is released, a sealed space formed between the tip portion of the first rib 31 and the cap 23 communicates with outside air, and thereafter, the sealing between the first rib 31 and the second rib 32 is released. As a result, even in a case where a pressure difference between an inside and an outside of the liquid storage bottle 2 occurs, the influence can be minimized and it is possible to prevent the liquid from adhering to the tip (the tip portion of the first rib 31) of the nozzle 22.

Figure 10:
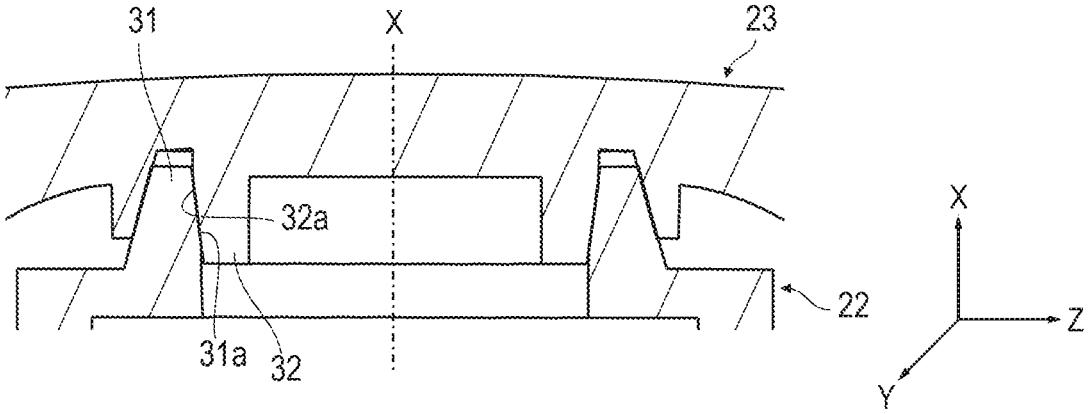
FIG. 10 is an enlarged cross-sectional view illustrating a modification example of the sealing unit according to the first example embodiment.

FIG. 10 is an enlarged cross-sectional view illustrating modification examples of the first rib and the second rib of the sealing unit of the first embodiment.

In order to further suppress the increase in the operation force required when opening or closing the cap 23, not only the outer peripheral surface 31*b* of the first rib 31 and the inner peripheral surface 33*a* of the third rib 33 can be inclined, but also the inner peripheral surface 31*a* of the first rib 31 and outer peripheral surface 32*a* of the second rib 32 can be inclined. Specifically, the inner peripheral surface 31*a* of the first rib 31 can be inclined with respect to the axial direction X of the nozzle 22 so that a diameter increases toward the tip portion of the first rib 31. In addition, the outer peripheral surface 32*a* of the second rib 32 can be inclined with respect to the axial direction X of the cap 23 so that a diameter decreases toward the tip portion of the second rib 32. Accordingly, a contact surface pressure between the first rib 31 and the second rib 32 decreases, and thus, it is possible to further suppress the increase in the operation force required when opening or closing the cap 23.

Second Example Embodiment

Figure 11:
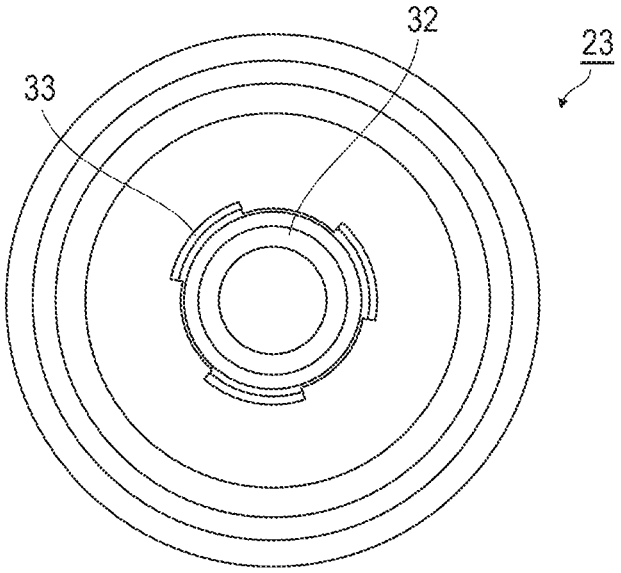
FIG. 11 is a bottom view of a cap according to a second example embodiment.
Figure 12:
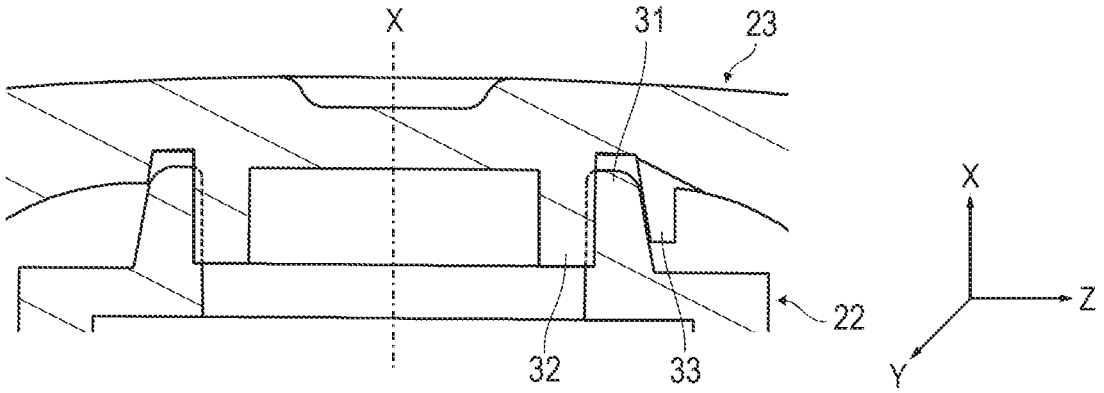
FIG. 12 is an enlarged cross-sectional view of a sealing unit according to the second example embodiment.

FIG. 11 is a bottom view of a cap 23 of a liquid storage bottle according to a second embodiment of the present disclosure. FIG. 12 is an enlarged cross-sectional view of a sealing unit of the liquid storage bottle according to the second embodiment. Hereinafter, the same components as those of the first embodiment are denoted by the same reference numerals in the drawings, description thereof will be omitted, and only configurations different from those of the first embodiment will be described.

In the first embodiment, when the cap 23 is closed, the sealed space is formed between the tip portion of the first rib 31 and the cap 23 is formed. Accordingly, in the case where a pressure difference between the inside and the outside of the liquid storage bottle 2 occurs, the liquid inside the liquid storage bottle 2 may be discharged when the cap 23 is opened. Meanwhile, in the second embodiment, the third rib 33 is formed in an arc shape. Accordingly, when the cap 23 is closed, the space formed between the tip portion of the first rib 31 and the cap 23 is not sealed and communicates with the outside air. Therefore, the outside air is not closed inside the liquid storage bottle 2, and in the case where the pressure difference between the inside and the outside of the liquid storage bottle 2 occurs, a possibility that the liquid inside the liquid storage bottle 2 is discharged when the cap 23 is opened can be minimized. The number of third ribs 33 is not particularly limited as long as the third ribs 33 are formed in an arc shape instead of an annular shape. That is, the number of third ribs 33 may be one or two or may be four or more, in addition to the illustrated three.

Third Example Embodiment

Figure 13:
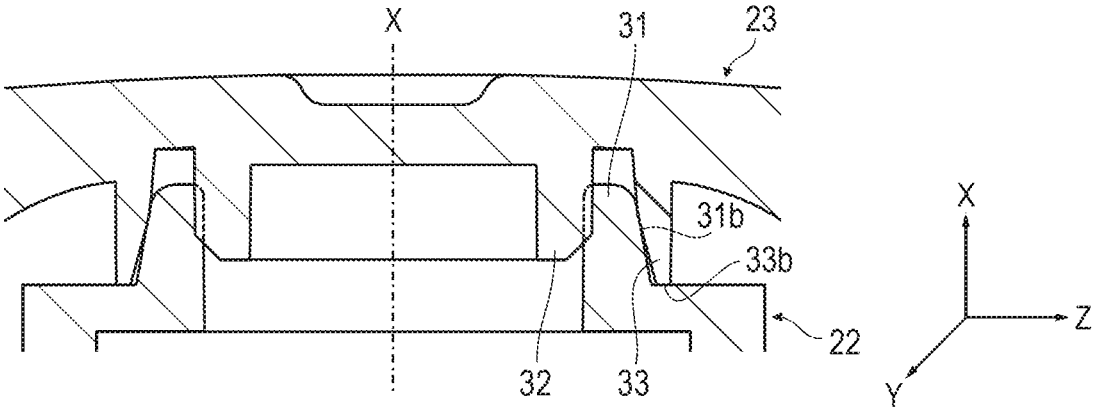
FIG. 13 is an enlarged cross-sectional view of a sealing unit according to a third example embodiment.

FIG. 13 is an enlarged cross-sectional view of a sealing unit according to a third embodiment of the present disclosure. Hereinafter, the same components as those of the above-described embodiments are denoted by the same reference numerals in the drawings, description thereof will be omitted and only configurations different from those of the above-described embodiments will be described.

In the third embodiment, the tip portion 33*b* of the third rib 33 abuts on the nozzle 22 in the axial direction X of the cap 23 when the cap 23 is mounted on the nozzle 22. Accordingly, a radially inward frictional force is generated at the tip portion 33*b* of the third rib 33, and thus, it is possible to prevent the third rib 33 from being deformed radially outward when an impact is applied from the outside such as dropping. Moreover, in this case, the tip portion 33*b* of the third rib 33 is radially separated from the outer peripheral surface 31*b* of the first rib 31. Accordingly, the tip portion 33*b* of the third rib 33 does not interfere with the outer peripheral surface 31*b* of the first rib 31 when the cap 23 is opened and closed. Therefore, even when the tip portion 33*b* of the third rib 33 abuts on the nozzle 22 when the cap 23 is mounted on the nozzle 22, the operation force required when opening and closing the cap 23 does not increase. Moreover, the tip portion 33*b* of the third rib 33 may abut on the nozzle 22 before the abutment surface 24 of the cap 23 abuts on the nozzle 22 so as to suppress excessive tightening of the cap 23.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-060581, filed Mar. 27, 2019, which is hereby incorporated by reference herein in its entirety.

What is claimed is:

1. A liquid storage bottle comprising:

a bottle main body;

a nozzle which has a discharge port through which a liquid stored in the bottle main body is discharged;

a cylindrical cap which is mountable on the nozzle to open or close the discharge port; and a sealing unit which seals the discharge port when the cap is mounted on the nozzle, wherein the sealing unit includes an annular first rib which is provided in the nozzle, an annular second rib which is provided in the cap and an annular or arc third rib which is provided in the cap, wherein the first rib protrudes in an axial direction of the nozzle along a peripheral edge portion of the discharge port, wherein the second rib protrudes in an axial direction of the cap from a surface of the cap facing the discharge port and includes an outer peripheral surface which is fitted to an inner peripheral surface of the first rib, wherein the third rib protrudes in the axial direction of the cap from the surface of the cap facing the discharge port and includes an inner peripheral surface which comes into contact with an outer peripheral surface of the first rib, and wherein the outer peripheral surface of the first rib is inclined with respect to the axial direction of the nozzle so that a diameter decreases toward a tip portion of the first rib and/or the inner peripheral surface of the third rib is inclined with respect to the axial direction of the cap so that a diameter increases toward a tip portion of the third rib.

2. The liquid storage bottle according to claim 1, wherein the tip portion of the third rib abuts on the nozzle in the axial direction of the cap when the cap is mounted on the nozzle.

3. The liquid storage bottle according to claim 2, wherein the tip portion of the third rib is separated radially from the outer peripheral surface of the first rib when the cap is mounted on the nozzle.

4. The liquid storage bottle according to claim 1, wherein an inclination angle $\theta 1$ of the outer peripheral surface of the first rib with respect to the axial direction of the nozzle and an inclination angle $\theta 2$ of the inner peripheral surface of the third rib with respect to the axial direction of the cap satisfy relationships of $0° \leq \theta 1 \leq 45°$ and $0° < \theta 2 \leq 45°$ or satisfy relationships of $0° < \theta 1 \leq 45°$ and $0° \leq \theta 2 \leq 45°$.

5. The liquid storage bottle according to claim 1, wherein the inner peripheral surface of the first rib is inclined so that the diameter increases toward the tip portion of the first rib and/or the outer peripheral surface of the second rib is inclined so that the diameter decreases toward a tip portion of the second rib.

6. The liquid storage bottle according to claim 1, wherein the cap includes an abutment surface which abuts on the nozzle in the axial direction of the cap when the cap is mounted on the nozzle.

7. The liquid storage bottle according to claim 1, wherein in the axial direction of the cap, a region of the outer peripheral surface of the second rib which is in contact with the first rib is closer to the nozzle than a region of the inner peripheral surface of the third rib which is in contact with the first rib.

8. The liquid storage bottle according to claim 1, wherein a male screw is formed on an outer peripheral surface of the nozzle and a female screw which is screwed to the male screw is formed on an inner peripheral surface of the cap.

* * * * *